United States Patent [19]

Prochaska et al.

[11] Patent Number: 5,036,583

[45] Date of Patent: Aug. 6, 1991

[54] PROCESS FOR MAKING CONTACT PIN - CONTACT BUSHING STRUCTURAL UNIT

[75] Inventors: Walter Prochaska; Paul-Rainer Molitor, both of Muehldorf, Fed. Rep. of Germany

[73] Assignee: Otto Dunkel GmbH, Muehldorf, Fed. Rep. of Germany

[21] Appl. No.: 522,097

[22] Filed: May 11, 1990

[30] Foreign Application Priority Data

May 12, 1989 [DE] Fed. Rep. of Germany ..... 3915644

[51] Int. Cl.[5] ..... H01R 43/04

[52] U.S. Cl. ..... 29/882; 29/874

[58] Field of Search ..... 29/882, 874, 879, 876, 29/881; 439/751

[56] References Cited

U.S. PATENT DOCUMENTS 4,572,606 2/1986 Neumann et al. .

4,614,029 9/1986 Neumann et al. ..... 29/874 X 4,693,002 9/1987 Neumann et al. ..... 29/874 X 4,774,763 10/1988 Palecek et al. ..... 29/874

FOREIGN PATENT DOCUMENTS 1136589 12/1968 United Kingdom .

*Primary Examiner*—Carl J. Arbes

*Attorney, Agent, or Firm*—Fleit, Jacobson, Cohn, Price, Holman & Stern

[57] ABSTRACT

A contact pin - contact bushing unit comprises a contact pin (3), having two spring-mounted, parallel legs (6) bordering an elongated hole formed by punching. The legs are employed for insertion into the opening of a circuit board. The legs (6) terminate in a shoulder (7) which serves to demarcate the insertion path. The contact bushing is formed by a contact spring bushing (2) with several contact springs (8). The contact springs extend roughly from the area of a clamping shoulder (8), which determines the fixture point of one of their ends, at a distance from the bushing axis to the area of the front pin insertion hole (13). In an intermediate area of the contact bushing, the contact springs display the shortest distance from the bushing axis. The shoulder bordering the contact pin insertion path is formed by the indicated clamping shoulder (7) of the contact spring bushing (2).

5 Claims, 1 Drawing Sheet

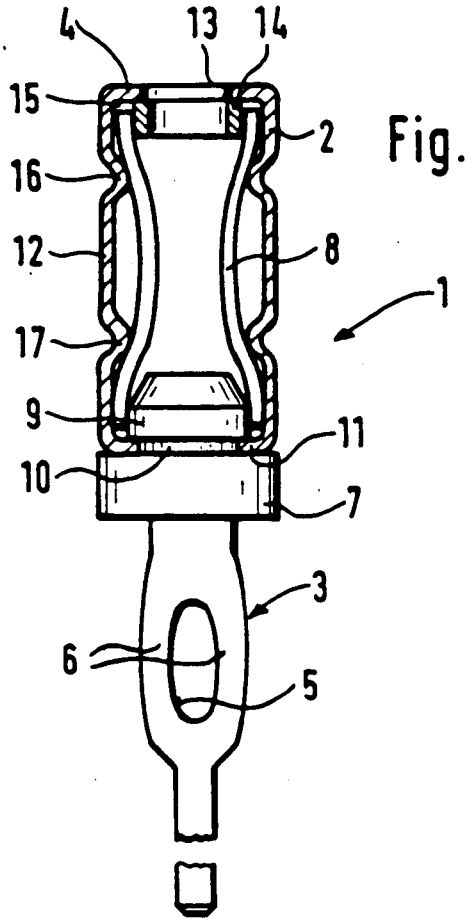
Fig. 1
Fig. 2
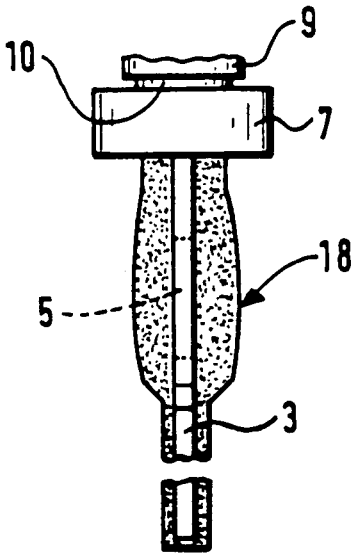
Fig. 3
Fig. 4
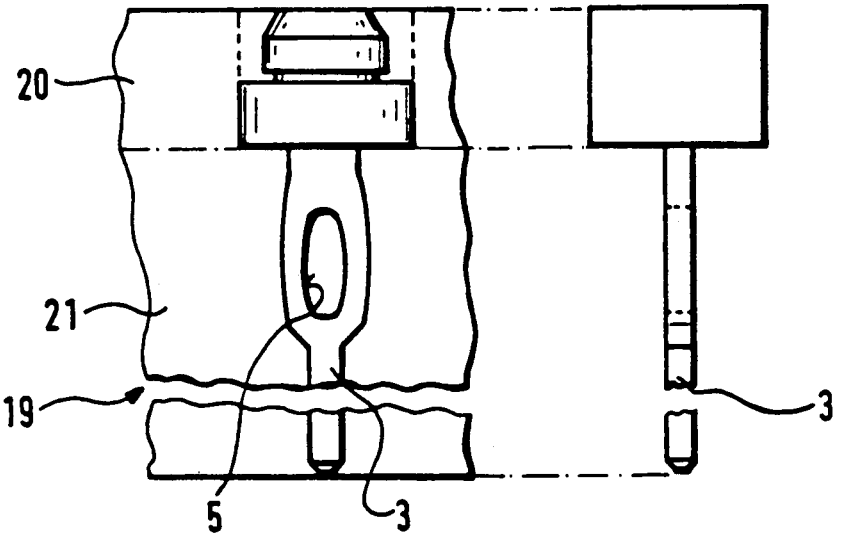

PROCESS FOR MAKING CONTACT PIN - CONTACT BUSHING STRUCTURAL UNIT

BACKGROUND OF THE INVENTION

The present invention relates to a contact pin contact bushing structural unit, in which the contact pin includes two approximately parallel legs for insertion into the hole of a circuit board. The legs border an elongated hale created by stamping, are spring-mounted, and end in a shoulder which serves to mark the boundary of the insertion path.

A contact pin—contact bushing structural unit of this type is known as disclosed in U.S. Pat No. 29,513. In this unit, both the contact pin and the contact bushing are formed from punched-out contact sheet metal. The contact bushing, which adjoins the shoulder terminating the insertion path of the contact pin, has the form of a tongue which displays a punched-out opening and which is bent backwards onto itself, along an axis that extends on a diagonal to the pin axis and that runs substantially through the area of the punched-out contact opening. The tongue has a certain elasticity which determines the contact force with which the tongue rests against a counter-contact pin introduced into the punched-out opening. When there are inconsistencies in the dimensions, which is ultimately unavoidable, there are relatively high contact resistances for small insertion forces, and vice versa. High insertion forces, which for their own part contribute to desirably small contact resistances, are impossible to achieve, however, whenever there are very many contact pin - contact bushing structural units of the described type fixed to a shared circuit board for the purpose of coupling the units with a counter-plug device comprising a number of counter-pins of the appropriate dimensions.

SUMMARY OF THE INVENTION

The present invention is an improvement over the prior art contact pin - contact bushing structural units in such a way that they can be easily affixed to a circuit board on only one side, while on the bushing side relatively low contact resistances are provided despite low insertion forces. The contact pin - contact bushing unit is designed so as to afford these qualities with a simple structure.

The contact pin - contact bushing structural unit according to the present invention comprises a contact bushing formed by a contact spring bushing with several contact springs, wherein the contact springs extend at a distance from the bushing axis, and thus from the approximate area of a clamping shoulder, to the area of the front pin insertion hole, while displaying the shortest distance from the bushing axis in the intermediate area or midlength portion of the bushing. The shoulder demarcating the insertion path of the contact pin is formed by the clamping shoulder of the contact spring bushing. This structural unit affords a correct mounting and sufficient contact with the circuit board, as well as a very small contact resistance for the insertion pin introduced into the contact spring bushing of the structural unit. Of greater importance, the clamping shoulder performs dual functions. The clamping shoulder represents an essential element of both the contact pin in demarcating the insertion path and of the contact spring bushing, inasmuch as it helps determine the fixture point of the contact spring ends by determining the precise position of these springs as required for their proper functioning.

At this point, reference is made to German Patent No. DE-PS 33 42 742 and Great Britain Patent No. GB-PS 11 36 589, which disclose contact bushing designs only by way of example.

In the inventive contact pin - contact bushing structural unit, the contact spring ends can directly rest on the cylindrical outer surface of the clamping shoulder and can be pressed against the latter. In this case the contact springs and the bushing elements containing them contribute to the total diameter of the contact spring bushing. However, a more compact design with a smaller diameter can be created when a cylindrical circular projection of smaller diameter, the foot of which is furnished with a circular groove, projects from the clamping shoulder. The groove holds in place the rim of the bushing element by surface contact with the clamping shoulder, while the ends of the contact springs located between the circular projection and a bushing element positioned over said projection are pressed against the circular projection.

The present invention also relates to a process for the production of contact pin - contact bushing structural units of the indicated design. In a first version, this process is basically characterized by the production of a turned part comprising the clamping shoulder with, when so desired, the cylindrical circular projection on one side and a contact pin section on the other side. After milling of the extraneous material on either side and thus the creation of a flat form, the elongated hole is punched out in a subsequent stamping step. The bushing element with contact springs is then applied and mounted in the area of the clamping shoulder. This process can employ bar material with a diameter that corresponds to the diameter of the turned part in the area of the clamping shoulder; the individual turned parts easily lend themselves to automatic production. This also applies to the finishing of the turned part, for the removal of extraneous material and punching of the elongated hole.

Another version of the inventive production process, in which it is not necessary to flatten the area of the contact pin, comprises the step of punching a blank of contact sheet metal material with two strip areas of differing thicknesses for forming the elongated hole. The blank is punched in an area with a thickness that corresponds to the diameter of the clamping shoulder and an area with a thicknesses corresponding to the desired thickness of the contact pin. The clamping shoulder and, when need be, the cylindrical circular projection are produced from the blank in a dressing process, well known in the art. The bushing element with contact springs is then applied to and mounted on the area of the clamping shoulder. This process also lends itself to production with automatic dressing equipment.

In another version of the process under the present invention, it is also possible to first produce a turned part comprising the clamping shoulder, when so desired, with the attached cylindrical circular projection, in order to then butt-weld the contact pin, which has been produced in a separate punching process, and simultaneously creating the elongated hole. The contact pin is butt-welded onto the clamping shoulder, on the side of the shoulder which is opposite the bushing element side.

Further details, advantages, and features of the invention emerge from the following description of an unrestrictive embodiment as shown in the diagram, express mention of which is made with regard to all details not described in the text.

BRIEF DESCRIPTION OF THE DRAWINGS

FIG. 1 shows a contact pin - contact bushing structural unit according to the invention, partially in section.

FIG. 2 illustrates a detailed view of the contact pin - contact bushing structural unit according to FIG. 1 showing the stages of production in implementation of the inventive production process.

FIGS. 3 and 4 are detailed views of the contact pin - contact bushing structural unit according to FIG. 1 showing the stages of production in implementation of the inventive production process in a first variation.

DETAILED DESCRIPTION OF THE DRAWINGS

FIG. 1 shows a contact bushing - contact pin structural unit 1 with a contact spring bushing 2 for the secure transmission of current to or from an insertion plug (not shown) introduced into the bushing, and with a contact pin 3 connected with the bushing 2. At the end of the contact spring bushing 2 is a spark-protection rim 4. To provide for the attachment of the contact pin - contact bushing structural unit 1 in the openings of an electric circuit board (not shown), a contact pin 3 of somewhat flat design at the end opposite the opening for the insertion plug is provided with two approximately parallel legs 6 bordering an elongated hole 5 formed by punching. The legs 6 end in a shoulder which serves to demarcate the insertion path and which is formed by the clamping shoulder 7 of the contact spring bushing 2. As can be seen, the back ends of contact springs 8 inserted into the bushing rest on a cylindrical circular projection 9, which project from the clamping shoulder 7 and which includes a circular groove 10 at its base. The bushing element 12 is formed of a deformable jacket with thin walls. The flanged rim 11 of the bushing element 12 of the contact spring bushing 2 fits into the circular groove 10. The rim 11, when coming to rest against the clamping shoulder 7, presses against the contact springs 8 located between it and the circular projection 9.

Inside of the spark-protection rim 4, a circular element 14 is provided formed by a flanged rim and displaying a central pin opening 13. The circular element 14 rests against the border, the inner diameter of which is somewhat smaller than the pin insertion hole 13 provided in the bushing element 12. The contact springs 8 distributed over the inner circumference, are attached in the area of the clamping-surface shoulder 7 and can be moved at one end in an annular gap 15 between the bushing element 12 and the circular element 14.

To create the arch of the contact springs 8, curving radially inward as shown in FIG. 1, the bushing element 12, at two points axially displaced relative to the circular element 14 or the circular projection 9, is provided from the outside with ring beads 16 and 17 projecting radially in the inward direction. The circular beads 16 and 17 rest against the contact springs 8 to elastically deform the springs 8 radially in the inward direction. In the area of each circular bead 16, 17, the bushing element 12 has an inner diameter which is smaller than the outer diameter of the circular element 14 supporting the movable ends of the contact springs 6, by the amount of twice the diameter of the contact springs 8.

Instead of furnishing two circular beads, the circumferential area of the bushing element 12 can be reduced to the diameter otherwise achieved by the circular beads. In this design, the shoulders bordering the circumferential area of the bushing element 12 perform the function of the circular beads of the design shown in FIG. 1.

The contact pin contact bushing structural units of the type like that of the present invention can be produced in various ways.

As shown in FIG. 2, a turned part 18 is produced which comprises on one side the clamping shoulder 7 and the cylindrical circular projection 9, with the interposed circular groove 10, and on the other side, a contact pin section 3. Removal of the extraneous material indicated by the dotted areas on both sides produces the flat form of the contact pin 3 to which the elongated hole is applied by stamping in the subsequent stage. The extraneous material is removed by means of bilateral milling. This step is followed by mounting of the bushing element 12 and the contact springs 8, as well as the circular element 14 which supports them, through their application to the surface of the clamping shoulder 7 of the contact pin 3. This is followed by elastic deformation of the contact springs 8 by rolling the circular beads 16 and 17.

As shown in FIGS. 3 and 4, it is also possible to stamp out a blank, while simultaneously forming the elongated hole 5, from contact sheet strip material 19 with two strip areas 20, 21 of differing thicknesses. Specifically, the stamping is performed in an area 20 with a thickness corresponding to the diameter of the clamping shoulder 7 and an area 21 with a thickness corresponding to the desired thickness of the contact pin. Following this stage the clamping shoulder 7 and, when so desired, the cylindrical circular projection 9 are formed with the blank in a dressing procedure, before the bushing element with the contact springs being applied and mounted in the area of the clamping shoulder, in the manner already described.

As a final alternative, a turned part can be produced which encompasses the clamping shoulder and, when so desired, the attached cylindrical circular projection. The contact pin 3 may be produced in a separate stamping procedure, with simultaneous creation of the elongated hole 5. It may then be butt-welded on the side of the turned part 18 opposite the bushing element, to the clamping shoulder, in a procedure that also can be very efficiently performed with the aid of automatized mechanisms.

The foregoing description is by way of example only and is not intended to limit the present invention in any way except as set forth in the following claims.

We claim:

1. A process for making a contact pin-contact bushing unit comprising the steps of:

providing a turned part comprising an elongated piece of contact pin material forming a contact pin section at one end and a clamping shoulder at the other end thereof;

forming a flat contact pin by removing extraneous material by bilateral milling said contact pin material at said contact pin section;

punching out an elongated hole in said contact pin to form an elongated hole in said contact pin; and mounting a bushing element with contact springs at said clamping shoulder.

2. A process for making a contact pin-contact bushing unit comprising the steps of:

providing a blank of contact sheet material comprising first and second areas of first and second thicknesses, respectively, said first thickness corresponding to a diameter of a clamping shoulder and said second thickness corresponding to a desired thickness of a contact pin;

punching out an elongated hole in said second area to form an elongated hole in said contact pin; and mounting a bushing element with contact springs at said clamping shoulder.

3. The process of claim 2, and further comprising the step of forming a cylindrical circular projection on said contact pin material.

4. The process of claim 2, and further comprising the step of removing extraneous material from the blank to form a circular cross section of the clamping shoulder.

5. A process for making a contact pin-contact bushing unit comprising the steps of:

providing a turned part comprising an elongated piece of contact pin material at one end and a clamping shoulder at the other end thereof;

removing extraneous material from said piece of contact pin material to form a flat contact pin;

punching out an elongated hole in said contact pin material to form an elongated hole in said contact pin;

butt-welding a cylindrical circular projection onto said clamping shoulder; and mounting a bushing element with contact springs to at said clamping shoulder.

* * * * *